US010358195B1

(12) United States Patent
Langlois

(10) Patent No.: US 10,358,195 B1
(45) Date of Patent: Jul. 23, 2019

(54) SYSTEM FOR EFFECTIVELY INCREASING THE STROKE RANGE OF AN ACTUATOR AND DEFLECTION ANGLE OF A FLUID HINGE TRIM TAB SYSTEM FOR ATTITUDE CONTROL AND STABILIZATION OF A WATERCRAFT

(71) Applicant: Joseph R Langlois, Coral Springs, FL (US)

(72) Inventor: Joseph R Langlois, Coral Springs, FL (US)

( * ) Notice: Subject to any disclaimer, the term of this patent is extended or adjusted under 35 U.S.C. 154(b) by 0 days.

(21) Appl. No.: 16/032,653

(22) Filed: Jul. 11, 2018

(51) Int. Cl.
*B63B 1/22* (2006.01)
*B63B 39/06* (2006.01)

(52) U.S. Cl.
CPC ..... *B63B 39/061* (2013.01); *B63B 1/22* (2013.01)

(58) Field of Classification Search
CPC ..... B63B 39/061; B63B 1/22
See application file for complete search history.

(56) References Cited

U.S. PATENT DOCUMENTS 3,370,561 A * 2/1968 Ilon ..... B63B 39/061 114/285
7,013,825 B1 * 3/2006 D'Alessandro ..... B63B 39/061 114/286

* cited by examiner

*Primary Examiner* — Anthony D Wiest
(74) *Attorney, Agent, or Firm* — Melvin K. Silverman

(57) ABSTRACT

A system and method for effectively increasing the stroke range of an actuator and deflection angle of a fluid hinge trim tab system for attitude control and stabilization of a water craft includes at least one actuator (20), a scissor joint (25) made up of a rigid structural member (27) and hinge member (33), a scissor hinge mount (35), and an elongate substantially planar surface (32). The scissor joint (25) is connected to the scissor hinge mount (35) and the elongate substantially planar surface (32) at opposite ends. Extension of actuator ram (36) allows for rotation of the rigid structural member (27) which creates a rotational angle (48) and an angle of deflection (40) between the elongate substantially planar surface (32) and the hull (21) of the water craft, which effectively increases the stroke length of the actuator (20). The system also allows for retraction of the actuator (20).

17 Claims, 8 Drawing Sheets

SYSTEM FOR EFFECTIVELY INCREASING THE STROKE RANGE OF AN ACTUATOR AND DEFLECTION ANGLE OF A FLUID HINGE TRIM TAB SYSTEM FOR ATTITUDE CONTROL AND STABILIZATION OF A WATERCRAFT

FIELD OF THE INVENTION

The present invention relates to an improvement in classical trim-tab technology to enhance the general hydrodynamic performance of a marine craft inclusive of the fuel efficiency thereof.

BACKGROUND OF THE INVENTION

So-called boat leveling devices of the trim-tab type have been known for many years and various forms of them have been developed in an effort to increase attitude control and stability of water crafts, as well as improving general hydrodynamic efficiency inclusive of decrease of flow velocity under the hull and fuel efficiency.

The prior art trim-tabs which typically are provided in pairs to enhance stability of the craft, are shown in FIGS. 1, 2, 3, 4, and 5 herewith. More particularly, FIG. 1 shows a traditional external trim-tab 2.1 of which is attached directly to transom 3.1 of a craft 100.1 and in which the attitude of the trim-tab is controlled through a hydraulic piston assembly 4.1 which controls relative angulation of the hull relative to level of the water. Also shown in FIG. 1 is a servo-loop wiring 9.1 by which assembly 4.1 are controlled.

The prior art shown in FIG. 2 differs from that of FIG. 1 only in that the trim tab 2.2 is positioned beneath stern 6.2 of the craft 100.2 and forward of propeller 8.2. Therein, the direction of assembly 4.2 and hydraulic piston 5.2 are aligned with the gravity vector as opposed to the angled position of the hydraulic assembly shown in the prior art of FIG. 1.

The prior art shown in FIG. 3 demonstrates the hinge common in most trim tabs, that is, a pivot hinge 1.3 that fastens the planar surface 2.3 of the trim tab to the watercraft. The pivot hinge is fixed in a specific location, and requires an actuator 5.3, mounted at a non-right angle to allow the planar surface to descend.

The prior art shown in FIG. 4 shows a similar issue where the planar surface 2.4 is fastened directly to the hull of the watercraft by a living hinge 7.4. This living hinge 7.4 is in a fixed location as well, and thus requires an actuator 5.4 mounted at a non-right angle, or the actuator 5.4 with a pivot mount to allow the planar surface 2.4 of the trim tab to descend.

The prior art shown in FIG. 5 shows an issue where the planar surface 2.5 is fastened directly to the transom of the watercraft by a bracket-like hinge 1.5. This bracket-like hinge 1.5 is in a fixed location as well, and thus requires an actuator 5.5 mounted at a non-right angle to allow the planar surface 2.5 of the trim tab to descend.

In general trim-tabs of the prior art, whether double or single acting, will operate upon the same principles and have a common objective, namely, that of contributing to the efficiency control of the boat's attitude, stabilization and general hydrodynamics.

There are significant differences between the prior art and the current invention. Primarily, the mounting of an actuator to a trim tab is direct in FIGS. 1, 2, 3, 4 and 5; meaning, looking to FIG. 4, the planar surface 2.4 is attached to driving end 8.4 of the actuator 5.4. This type of mounting is standard across all prior art trim-tabs referenced above, limiting the length of descent of the trim tabs to the actual "stroke range" of the actuator arm. "Stroke range" is a measurement dependent upon the length of the ram of the actuator. Generally, the longer the ram of the actuator the greater the angle of deflection between the hull and the trim-tab. This increase in the deflection angle increases the lift generated in the stern end of the watercraft, therefore causing the bow to lower and allow for more hydrodynamically efficient behavior from the marine craft.

Along with the increase in the angle of deflection, the forces of the water in contact with the hull and, more importantly, the trim-tab are also increased; making the stresses on the rams of the actuator bear a greater force. The current invention also allows for a distribution of the force to handle the force increase.

SUMMARY OF THE INVENTION

The instant invention relates to a system for effectively increasing the "stroke range" of an actuator and deflection angle of a fluid hinge trim tab system for attitude control and stabilization of a water craft. The system comprises at least one actuator that is connected at a distal end of said at least one actuator to a transom of a hull of said watercraft, a scissor-joint that is made up of a rigid structural member and a hinge member, said hinge member being connected to a scissor-hinge mount where said scissor-hinge mount is connected in a fixed position to said transom of said hull of said water craft, said rigid structural member being connected at a distal end to said hinge member, said rigid structural member being connected pivotally at a proximal end to an elongate substantially planar surface, said actuator pivotally connected at a distal end to substantially a center of said rigid structural member of said scissor joint. In an embodiment using either a single actuator or multiple actuators, said actuator has both retractable and extendable features.

The system further comprises a deflection angle which exists between said transom of said hull of said water craft and said elongate substantially planar surface. The deflection angle is controllable by said at least one actuator. The desired deflection angle will be different given speed, weight, size, shape and center of gravity of said water craft.

The system further comprises a rotational angle existing between said transom and said rigid structural member. This rotational angle is more specifically the angle the rigid structural member will rotate, or pivot, around the hinge member.

In an embodiment that either contains a single or multiple actuators, these actuators can vary in type. In that case, the system further comprises actuators that can be of the electrical, mechanical, manual, or hydraulic type. Different actuators are best suited for different applications and different financial situations; it is important that the system be adaptable to function with the types of actuators listed above.

The system has an embodiment where said actuator at substantially a center of said rigid structural member of said scissor joint comprises the center of said rigid structural member. The placement of connection between said actuator and said substantially a center of said rigid structural member is important, as the actual length of effective "stroke range" will slightly change dependent upon on that placement.

The instant invention also relates to a method for effectively increasing the "stroke range" of an actuator and deflection angle of a fluid hinge trim tab system for attitude control and stabilization of a water craft. The method comprises extending said at least one actuator in a downward direction so that said rigid structural member begins to rotate about a hinge point, creating said rotational angle, driving said elongate substantially planar surface to achieve a desirable said angle of deflection, rotating said rigid structural member until said actuator's maximum "stroke range" is reached.

In general trim-tabs of the prior art, whether double or single acting, will operate upon the same principles and have a common objective, namely, that of contributing to the efficiency control of the boat's attitude, stabilization and general hydrodynamics. Allowing for this effective "stroke range" increase in the present invention will allow for an enhanced ride, a reduction in average fuel burn at planing speeds, and will allow also give added strength to combat the forces created on the trim tab from the water in which is being deflected.

DETAILED DESCRIPTION OF THE INVENTION

Figure 1:
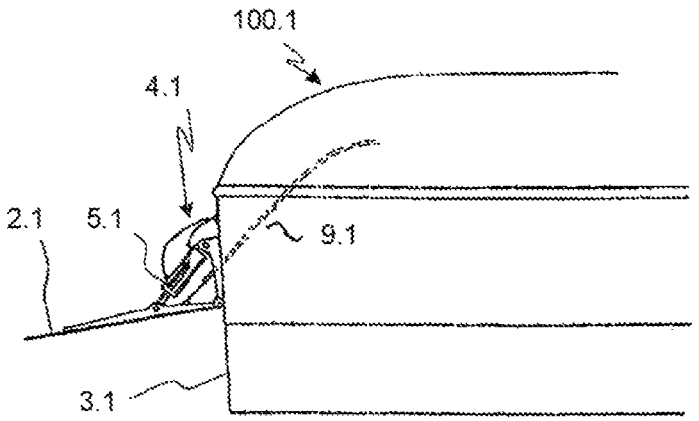
Fig. 1 (PRIOR ART)
FIG. 1 is a schematic view of a first prior art trim tab system.
Figure 2:
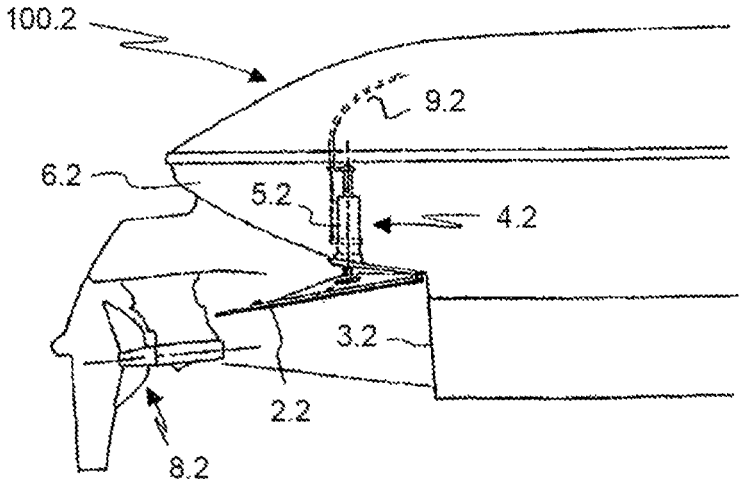
Fig. 2 (PRIOR ART)
FIG. 2 is a schematic view of a second prior art trim tab system.
Figure 3:
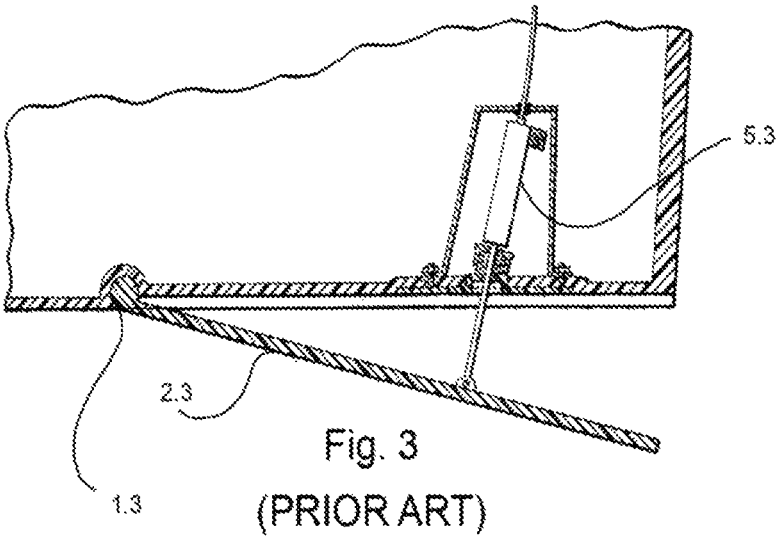
Fig. 3 (PRIOR ART)
FIG. 3 is a schematic view of a third prior art trim tab system.
Figure 4:
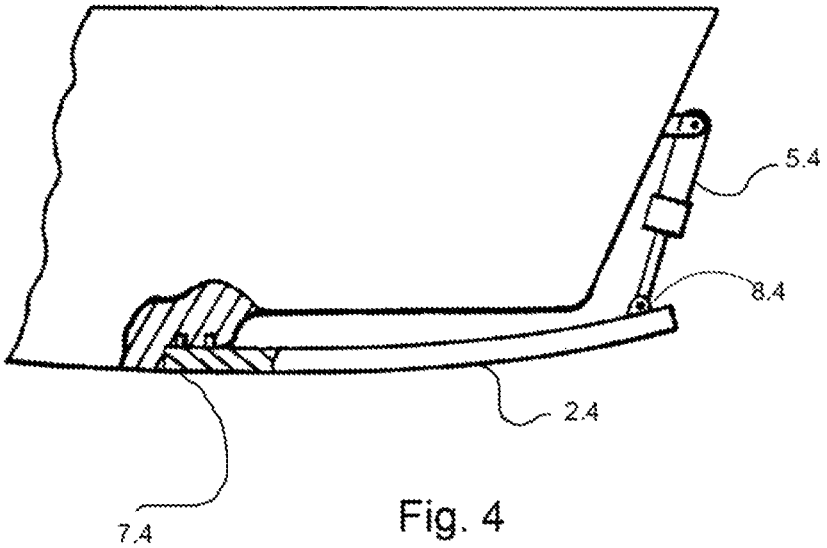
Fig. 4 (PRIOR ART)
FIG. 4 is a schematic view of a fourth prior art trim tab system.
Figure 5:
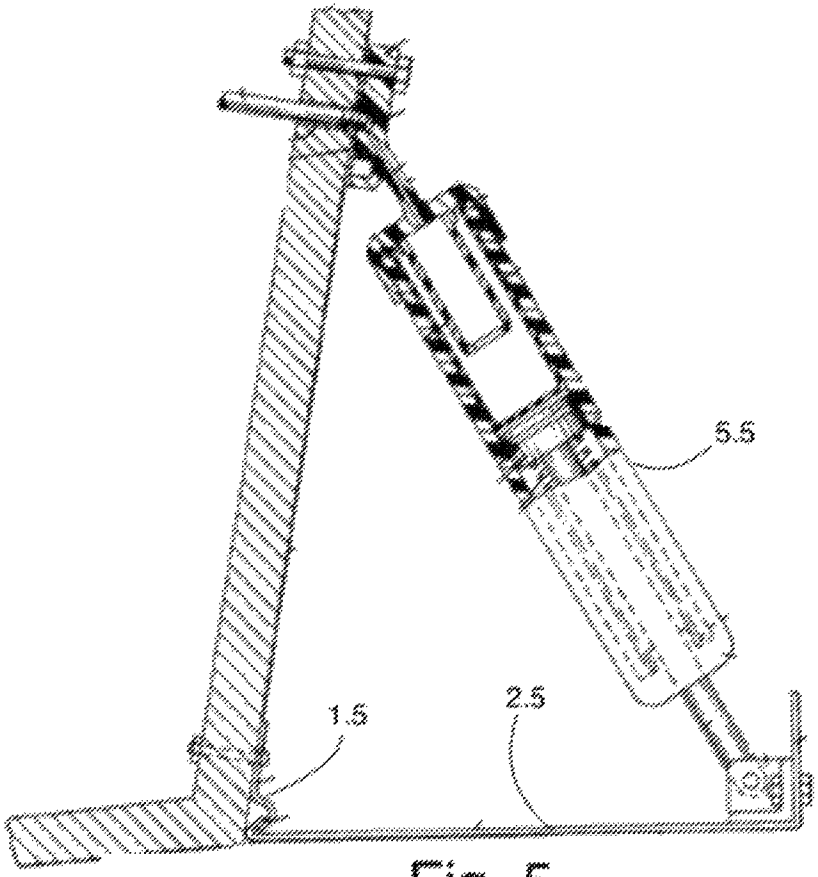
Fig. 5 (Prior Art)
FIG. 5 is a schematic view of a fifth prior art trim tab system
Figure 6:
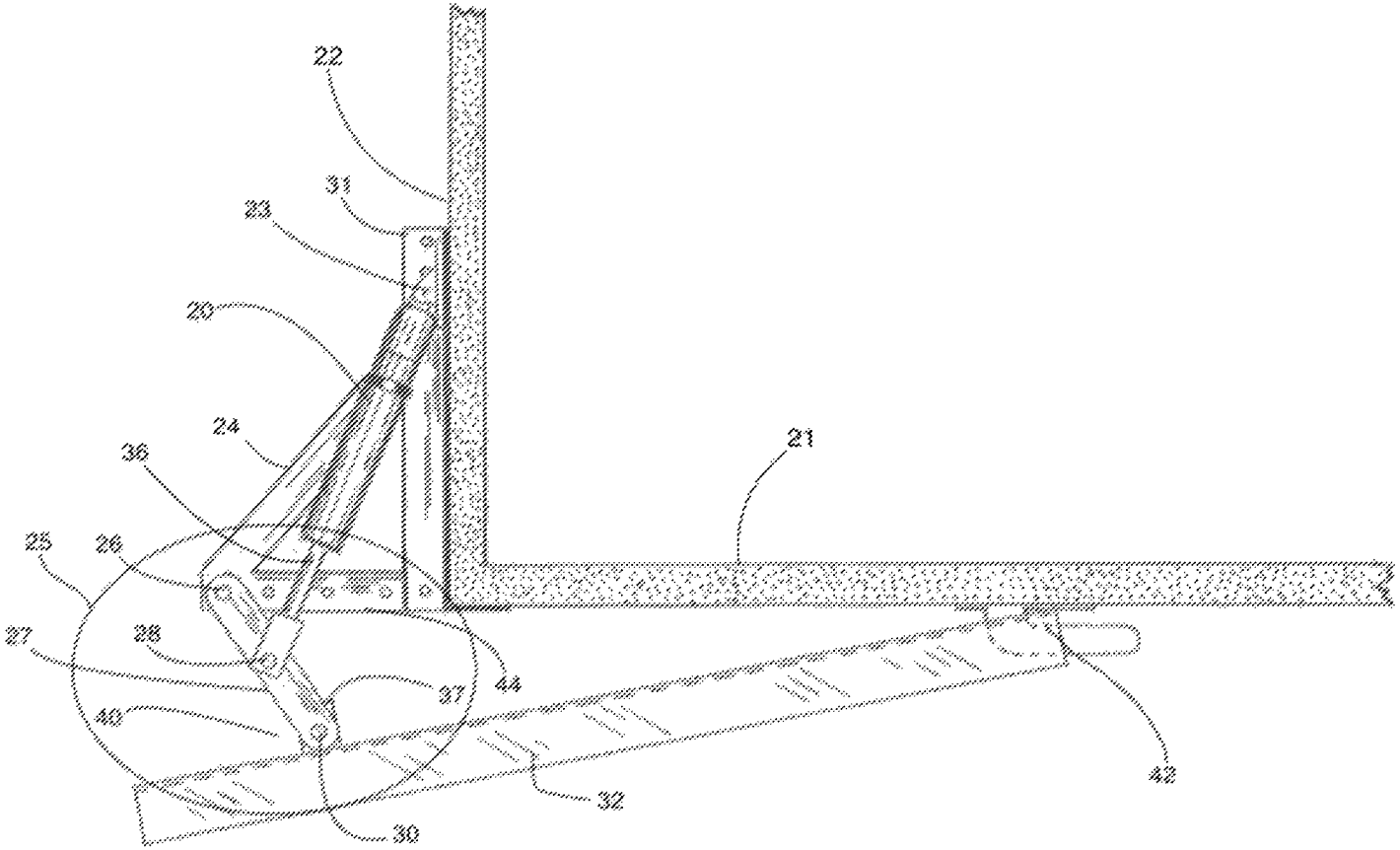
FIG. 6 is side view of the present invention in a fully extended position.
Figure 7:
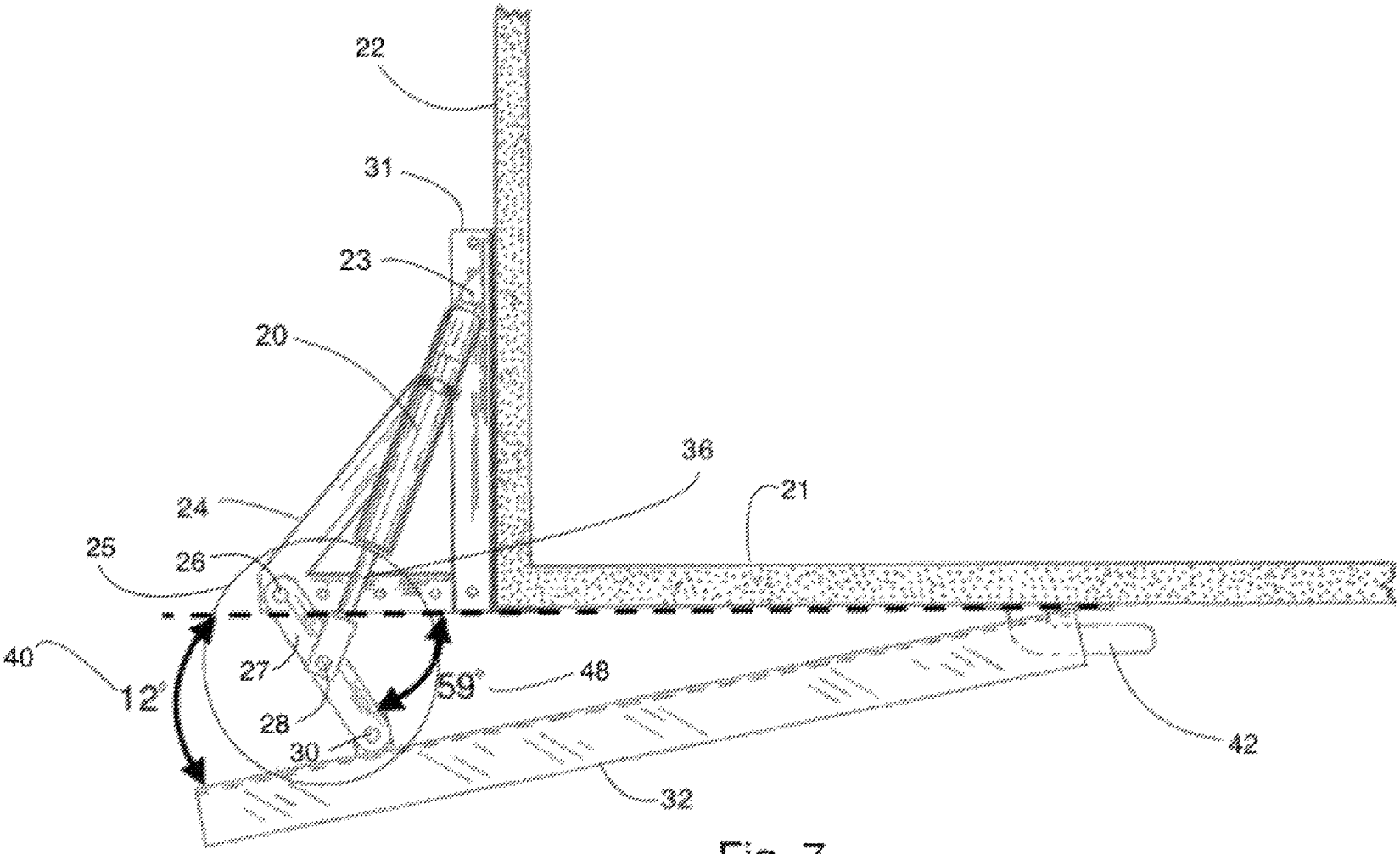
FIG. 7 is side view of the present invention in a fully extended position including detailed angle of deflection and angle of rotation illustrations.
Figure 8:
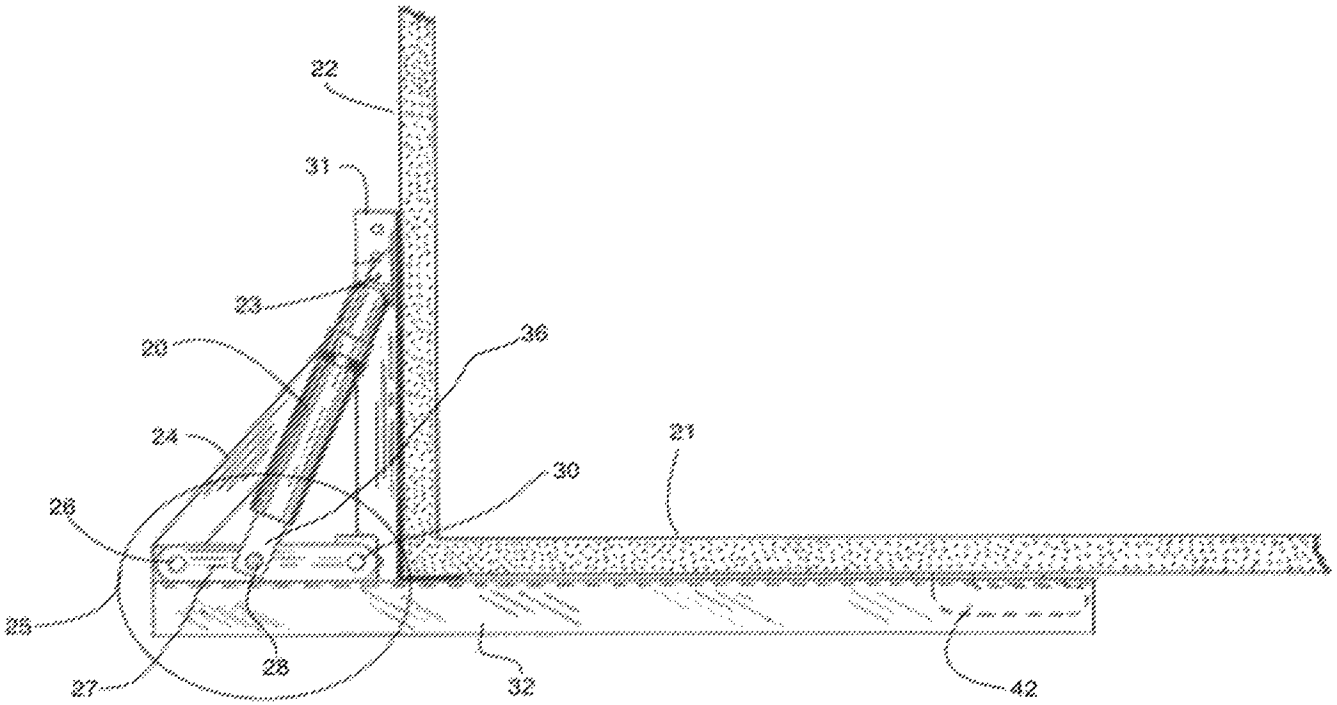
FIG. 8 is side view of the present invention in a fully retracted position.
Figure 9:
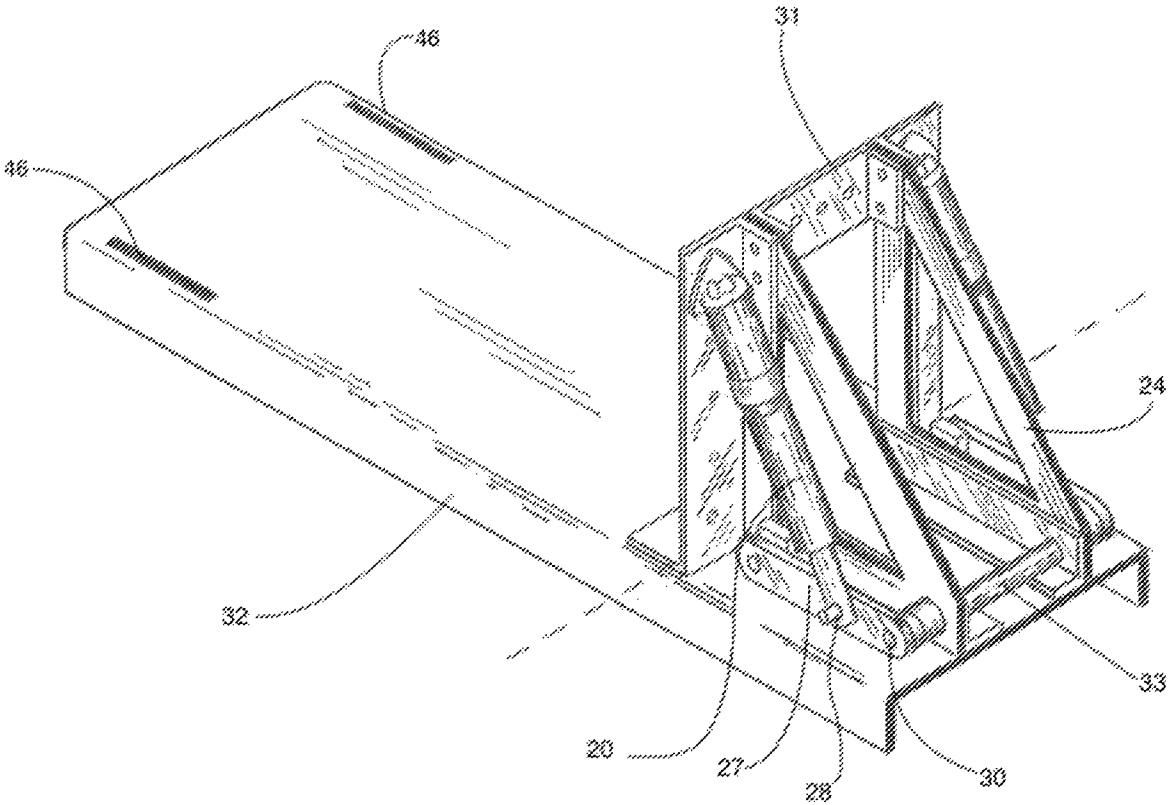
FIG. 9 is an angled, isolated view of the present invention in the up position.

With reference to the schematic view of FIGS. 6-8, the stern and mid-hull of a water craft are shown. More particularly, a water craft may be seen to include a hull 21 and a transom 22. Attached by a pivoting connection 23 to the transom 22 is an actuator 20. Contained within the actuator 20 is an actuator ram 36. The actuator ram 36 is the part of the actuator 20 which extends and retracts. The actuator ram 36 can be seen in a fully retracted position in FIG. 8 and in an extended position in FIGS. 6 and 7.

The side of the actuator ram 36 which is not in connection with the hull 21 is in connection with a scissor joint 25, as shown in the bubble in FIGS. 6, 7, and 8. The scissor joint 25 is the linkage which makes the effective "stroke range" extension possible. In a typical trim tab system as seen in the prior art references, in FIGS. 1, 2, 3, 4, and 5, the actuator ram 36 is in connection with the trim tab surface itself, giving only the "stroke range" of the actuator ram 36 itself. By adding this connection via scissor joint 25, the "stroke range" increases, as does the angle of deflection 40, giving the water craft a much-improved attitude and much improved control which leads to better performance and reduce fuel burn. The scissor joint 25 itself is made of a rigid structural member 27 and hinge member 33, seen in FIGS. 6, 7, 8, 9, and 10.

The rigid structural member 27 has three connection points: the hinge point 26, the actuator connection point 28, and the planar surface (trim tab) connection point 30, as seen in FIGS. 6, 7 and 8. The hinge point 26 is at a distal end of the rigid structural member 27 and is connected to a scissor-hinge mount 35. The actuator connection point 28 is connected to the actuator ram 36 at substantially a center point on the rigid structural member 27. Being substantially at a center is important, as it may vary exactly where this connection point will occur depending on the size of the water craft, performance capabilities of the water craft, and the forces that will be generated on the scissor joint; it may not be exactly at the center or it may be. The trim tab connection 30 occurs at a proximal end of the rigid structural member 27 and is connected at a tab connection point 37 on the top side of an elongate substantially planar surface 32. Dependent upon the user of the invention, the tab connection point 37 can either be a bolted or welded connection on the elongate substantially planar surface 32. The elongate substantially planar surface 32 is connected to the bottom side of the hull 21 to a fluid hinge 42, as seen in FIGS. 6, 7, and 8. The fluid hinge 42 is a type of trim tab connection which is defined in this inventor's previous patent application Ser. No. 15/681,932. The substantially elongate planar surface 32 will have two slots 46 where the fluid hinge 42 connects that are wide enough in tolerance to have the tongue like elements fit into place. When the substantially elongate planar surface 32 is in an extended actuator position as seen in FIG. 7, the force of the water pushing the substantially elongate planar surface 32 is what will hold the substantially elongate planar surface 32 in contact with the hull 21, eliminating the need for a fixed, pivot, or living hinge connection.

Figure 10:
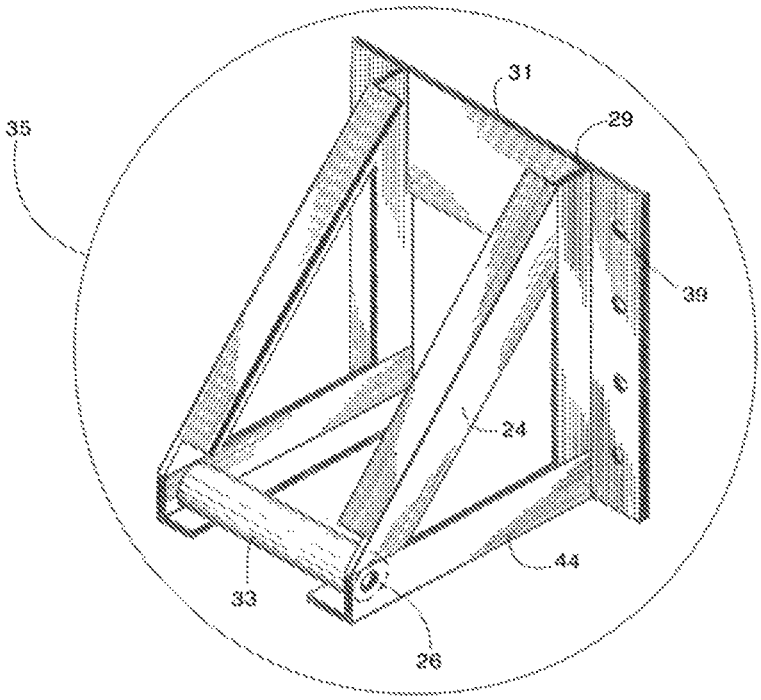
FIG. 10 is a schematic view of a scissor-hinge mount element of the present invention.

The actuator 20 is typically designed to withstand the force for the size tab and the size hull of a water craft in which it is being used, but being that the "stroke range" of the actuator 20 is effectively increased, the forces created by the increased angle of deflection 40 from the water will likely exceed what the actuator 20 is specified to withstand. The scissor-hinge mount 35, detailed in FIG. 10, is the solution to the problem this application presents. The scissor-hinge mount 35 is made with a sufficiently strong material to withstand and disperse the forces observed by the elongate substantially planar surface 32 and the scissor joint 25. The scissor-hinge mount 35 utilizes a mounting bracket 31, two angled support members 24, and two horizontal support members 44. The mounting bracket 31 is to be bolted at the bolt holes 39 to the transom 22 of the marine craft. The height of the mounting bracket on the transom 22 will depend on the size of the actuator 20, shown in FIGS. 6, 7, and 8. The high end of the angled support members 24 is to either be bolted or welded at the connection point 29, as seen in FIG. 10, to the mounting bracket 31. The low end of the angled support members 24 is to be fixed at the far end of the horizontal support members 44, and is to contain a hole sufficient in size to have the hinge member 33 fit through the both the angled support members 24 and the horizontal support members 44 so that the hinge point 26 can be set.

The method in which this system is said to function properly is simple. Upon activation, the actuator 20 (of any type listed above), is said to be thrusted in a downward direction, shown in FIG. 7. As the actuator 20 is thrusted downward, the rigid structural member 27 begins to rotate about the hinge point 26. This rotation creates a rotational angle 48. With the rotational angle 48 being increased through the downward thrust of the actuator 20, the elongate substantially planar surface 32 is driven downward until a desired angle of deflection 40 is achieved. When the actuator 20 reaches full stroke, the rotational angle 48 and angle of deflection 40 reach maximums, but this also means the stroke distance increased effectively surpassed what the "stroke range" would have been if the scissor hinge were not the connection at the actuator connection point 28.

Along with this extendable process, the invention allows for the retraction of the actuators shown in FIG. 6. The actuator 20 retracts in an upward direction, rotating the rigid structural member 27, which minimizes the rotational angle 48 as well as the angle of deflection 40 until the fully retracted position is reached as in FIG. 5. As the elongate substantially planar surface 32 is being thrusted downward and upward, the fluid hinge is capturing the motion of the elongate substantially planar surface 32. By capturing the motion the inventor means that the slots 46 of the elongate substantially planar surface 32 are being guided by the fluid hinge 42 to not allow the elongate substantially planar surface to slide out an allowable place and maintain proper course through retraction and extension.

In a preferred embodiment, the system is powered by a Lectrotab electrical/mechanical actuator that can be electrically controlled by a remote which can signal retraction or extension to the actuator. The actuator can be adjusted to preferred length or to max stroke length corresponding to desired angles of deflection, this length can be dependent upon the size, weight, shape and center of gravity of the water craft. All components of the system can vary in size dependent upon the size and shape of the hull of the watercraft

I claim:

1. A system for effectively increasing the stroke range of an actuator and deflection angle of a fluid hinge trim tab system for attitude control and stabilization of a water craft, comprising:

(a) at least one actuator pivotally connected at a proximal end of said at least one actuator to a transom of a hull of a watercraft, said at least one actuator having both extendable and retractable features;

(b) at least one scissor joint made up of a hinge member and a rigid structural member;

(c) said hinge member connected to a scissor-hinge mount, said scissor-hinge mount fixed to said transom of said watercraft;

(d) a distal end of said rigid structural member connected to said hinge member;

(e) a proximal end of said rigid structural member connected pivotally to a top side of an elongate substantially planar surface, said elongate substantially planar surface hinged to a bottom side of said hull substantially near said transom of said water craft; and (f) said actuator pivotally connected at a distal end of said actuator at substantially a center of said rigid structural member of said scissor joint.

2. The system as recited in claim 1, further comprising:

a deflection angle existing between said transom of said hull of said watercraft and said elongate substantially planar surface.

3. The system as recited in claim 2, further comprising:

said deflection angle controllable by said at least one actuator.

4. The system as recited in claim 1, further comprising:

a rotational angle existing between said transom of said hull of said watercraft and said rigid structural member.

5. The system as recited in claim 4, further comprising said rotational angle controllable by said at least one actuator.

6. The system as recited in claim 1, wherein said at least one actuator comprises mechanical type actuators.

7. The system as recited in claim 1, wherein said at least one actuator comprises electrical type actuators.

8. The system as recited in claim 1, wherein said at least one actuator is comprises hydraulic type actuators.

9. The system as recited in claim 1, wherein said at least one actuator comprises manual type actuators.

10. The system as recited in claim 1(f), wherein said distal end of said actuator at substantially a center of said rigid structural member of said scissor joint comprises the center of said rigid structural member.

11. The system as recited in claim 1(e), wherein said elongate substantially planar surface comprises a planar surface.

12. A method for effectively increasing a stroke range of an actuator and deflection angle of a fluid hinge trim tab system for attitude control and stabilization of a water craft, comprising:

(a) extending at least one actuator in a downward direction so that a rigid structural member begins to rotate about a hinge point, creating a rotational angle;

(b) moving an elongate substantially planar surface to achieve a desirable angle of deflection;

(c) rotating said rigid structural member until said actuator's maximum stroke range is reached; and (d) creating an extra effective stroke distance increase using a length from a distal end of said actuator at substantially a center to a proximal end of said rigid structural member.

13. The method as recited in claim 12, further comprising:

(e) retracting said at least one actuator in an upward direction;

(f) rotating said rigid structural member; and (g) minimizing said rotational angle.

14. The method as recited in claim 12, wherein said at least one actuator comprises mechanical type actuators.

15. The method as recited in claim 12, wherein said at least one actuator comprises electrical type actuators.

16. The method as recited in claim 12, wherein said at least one actuator is comprises hydraulic type actuators.

17. The method as recited in claim 12, wherein said at least one actuator comprises manual type actuators.

* * * * *